US006188164B1

(12) United States Patent
Brown et al.

(10) Patent No.: US 6,188,164 B1
(45) **Date of Patent: *Feb. 13, 2001**

(54) MOUNT ASSEMBLY FOR ARC LAMP

(75) Inventors: Randall D. Brown, Barrington; Lawrence Crainich, Charlestown; Joseph C. Swadel, Rockingham; Steven Walker, S. Acworth, all of NH (US)

(73) Assignee: Osram Sylvania Inc., Danvers, MA (US)

( * ) Notice: Under 35 U.S.C. 154(b), the term of this patent shall be extended for 0 days.

This patent is subject to a terminal disclaimer.

(21) Appl. No.: 09/065,980

(22) Filed: Apr. 24, 1998

Related U.S. Application Data

(60) Provisional application No. 60/046,125, filed on May 9, 1997.

(51) Int. Cl.[7] ..... H01J 1/02; H01J 61/34; H01J 5/48; F21V 21/14

(52) U.S. Cl. ..... 313/25; 313/11; 313/17; 362/416

(58) Field of Search ..... 313/25, 634, 269, 313/11, 17, 26, 283, 284, 285, 287, 290, 292; 362/390, 396, 416, 417, 363, 310

(56) References Cited

U.S. PATENT DOCUMENTS

| | | | | |
|---|---|---|---|---|
| 5,023,505 | * | 6/1991 | Ratliff et al. | 313/25 |
| 5,122,706 | * | 6/1992 | Parrott et al. | 313/25 |
| 5,136,204 | * | 8/1992 | Muzeroll et al. | 313/25 |
| 5,252,885 | * | 10/1993 | Muzeroll et al. | 313/25 |
| 5,339,001 | * | 8/1994 | King et al. | 313/25 |
| 5,521,458 | * | 5/1996 | Kulik, Jr. | 313/25 |
| 6,008,566 | * | 12/1999 | Brown et al. | 313/25 |

* cited by examiner

*Primary Examiner*—Nimeshkumar D. Patel
*Assistant Examiner*—Matthew J. Gerike
(74) *Attorney, Agent, or Firm*—William H. McNeill

(57) ABSTRACT

A mount assembly for supporting the arc tube of a lamp within an outer envelope has first and second axially aligned banding straps. Each of the straps has a closed crimp section and an open crimp section. The straps are positioned so that an open crimp section of one strap overlies a closed crimp section of the other strap, thereby equalizing tensions when the crimps are closed. The mount assembly includes also a mount frame comprised of two elongated rods which are affixed to the banding straps. The straps are mounted upon the glass stem of the lamp.

6 Claims, 3 Drawing Sheets

MOUNT ASSEMBLY FOR ARC LAMP

RELATED APPLICATION

This application claims the benefit of U.S. Provisional Application No. 60/046,125, filed May 9, 1997. Apparatus for fixing the mount assembly claimed herein to the glass stem is described and claimed in Attorney Docket No. 97-1-034 filed on even date herewith and incorporated by reference.

TECHNICAL FIELD

This invention relates to arc discharge lamps and more particularly to a new mount assembly for supporting the arc tube from the glass stem of the lamp.

BACKGROUND ART

In the manufacture of metalarc lamps, it is necessary to properly orient the arc tube within a lamp envelope.

This has been done in the past by hand-crimping a single metal strap having a mount frame comprised of a pair of elongated rods attached thereto to the glass stem of the lamp. The strap was clinched at a single point about the glass stem and frames. In addition to being labor-intensive, this method was ineffective; the proper alignment of the frames about the glass stem was not always achieved. Another problem common to this earlier procedure was maintaining a small, compact configuration of the band around the glass stem, so that subsequent manufacturing processes could be accommodated. A further problem with the aforesaid procedure was its inability to maintain proper stem tolerances and hand crimping pressure. Stem breakage was a fairly common occurrence. Needless to say, the hand clinching of the strap about the lamp frames and glass stem was both costly and inefficient.

DISCLOSURE OF INVENTION

It is, therefore, an object of this invention to obviate the disadvantages of the prior art.

It is another object of the invention to enhance arc discharge lamp mount assemblies.

It is another object of the invention to provide a mount assembly having a banding system that releases excess tension as it is affixed to the glass stem of the lamp.

These objects are accomplished, in one aspect of the invention, by the provision of a mount assembly which comprises first and second axially aligned annular banding straps. Each of the banding straps has a closed crimp section and an open crimp section diametrically opposed to one another. The banding straps are positioned so the closed crimp of the first strap overlies the open crimp of the second strap. A pair of diametrically opposed mount frame receiving areas are positioned substantially equidistantly between the crimp sections, and a mount frame, comprised of two elongated rods, is fixed to the banding straps, each of the rods having a portion fixed in one of the mount frame receiving areas.

This mount assembly can be attached to the glass stem in an efficient manner. The oppositely disposed open crimps of the two bands operate to equalize the forces applied when the crimps folded thereby greatly reducing breakage of the glass stems.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
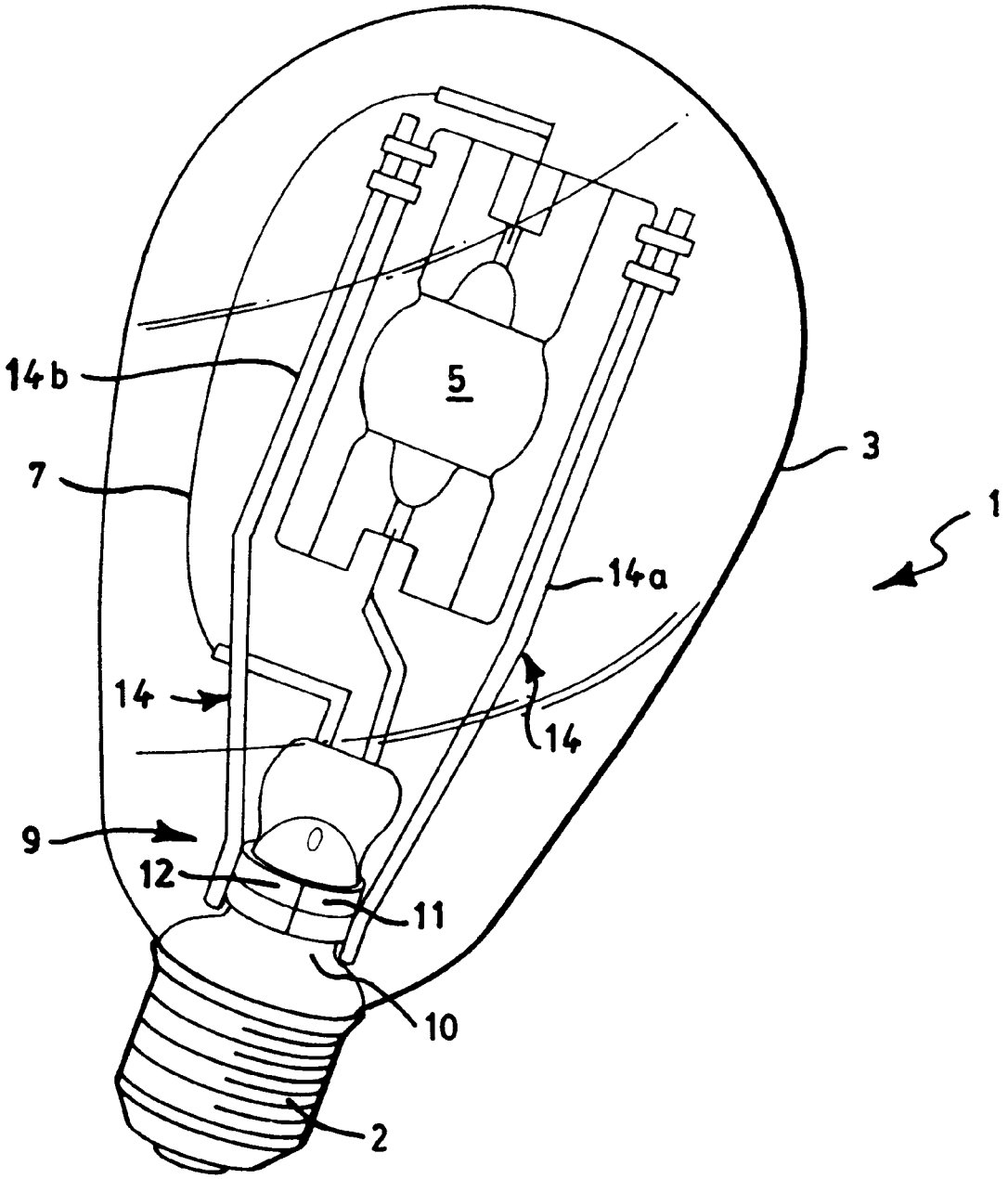
FIG. 1 is a perspective view of a lamp employing the invention.

Referring now to the drawings with greater particularity, there is shown in FIG. 1 an arc discharge lamp 1 having a mount assembly 9. The lamp 1 includes a metal base 2, an outer glass envelope 3 attached to the metal base 2 and a glass stem 10. The glass stem 10 supports the mount assembly 9 which includes banding straps 11 and 12 and mount frame 14 which includes elongated rods 14*a* and 14*b*. The rods support the arc tube 5.

Banding strap 11 has a closed crimp section 11*a*, an open crimp section 11*b* diametrically opposed thereto, and mount frame receiving areas 11*c* and 11*d* diametrically opposed to one another and positioned substantially equidistantly between the crimp sections.

Banding strap 12 has a closed crimp section 12*a*, an open crimp section 12*b* diametrically opposed thereto, and mount frame receiving areas 12*c* and 12*d* diametrically opposed to one another and positioned substantially equidistantly between the crimp sections. (See FIG. 2).

Each of the elongated rods 14*a* and 14*b* of the mount frame 14 has an area 14*c* which is formed to have a surface 14*d* which conforms to the inside circumference 11*e*, 12*e* of the banding straps 11 and 12 and, likewise, to the outer circumference of the glass stem 10. The surface 14*d* is preferably configured by coining and is an important consideration in reducing stresses upon the glass stem 10 when the crimp sections are folded.

Figure 2:
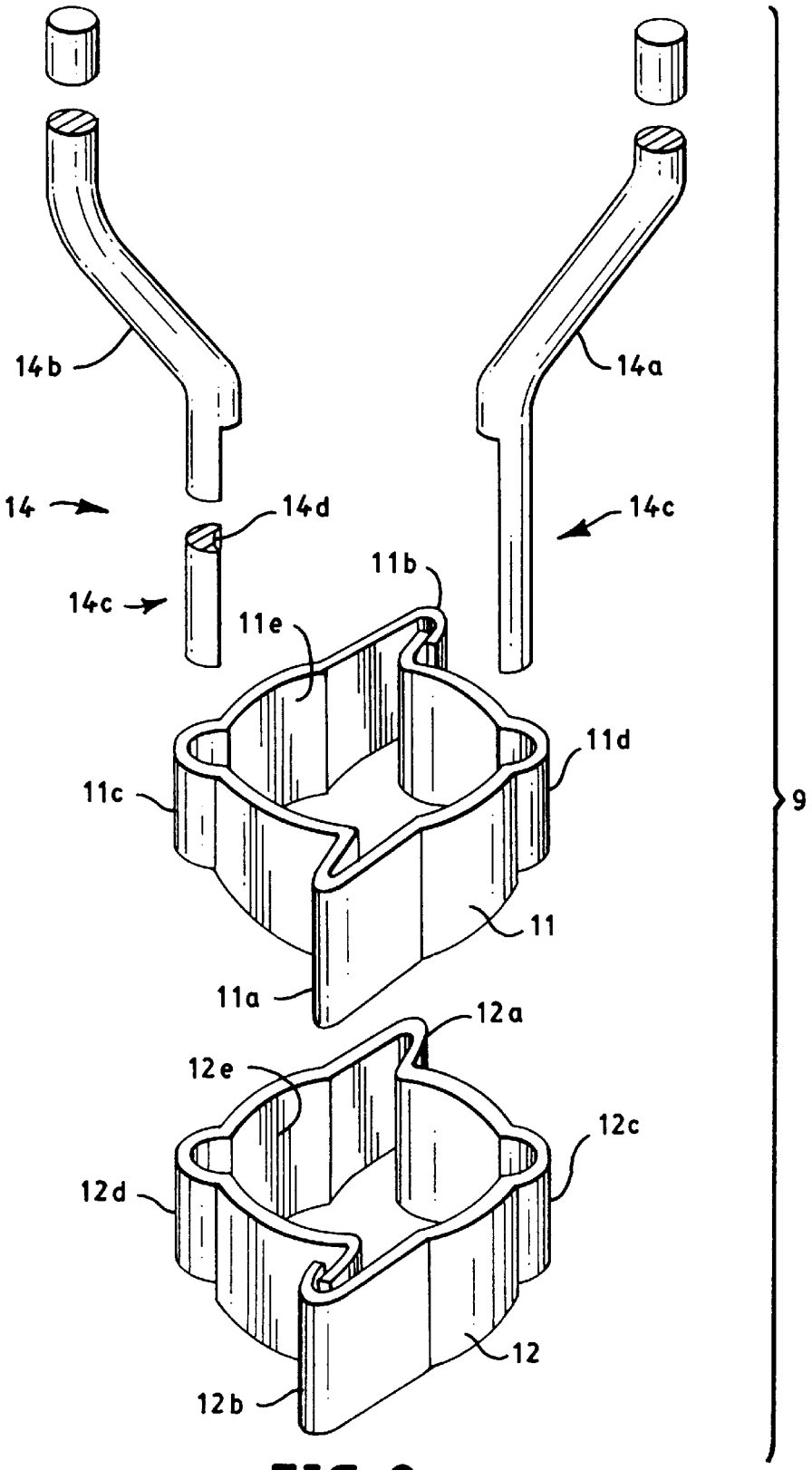
FIG. 2 is an exploded perspective view of the mount assembly of the invention.
Figure 3:
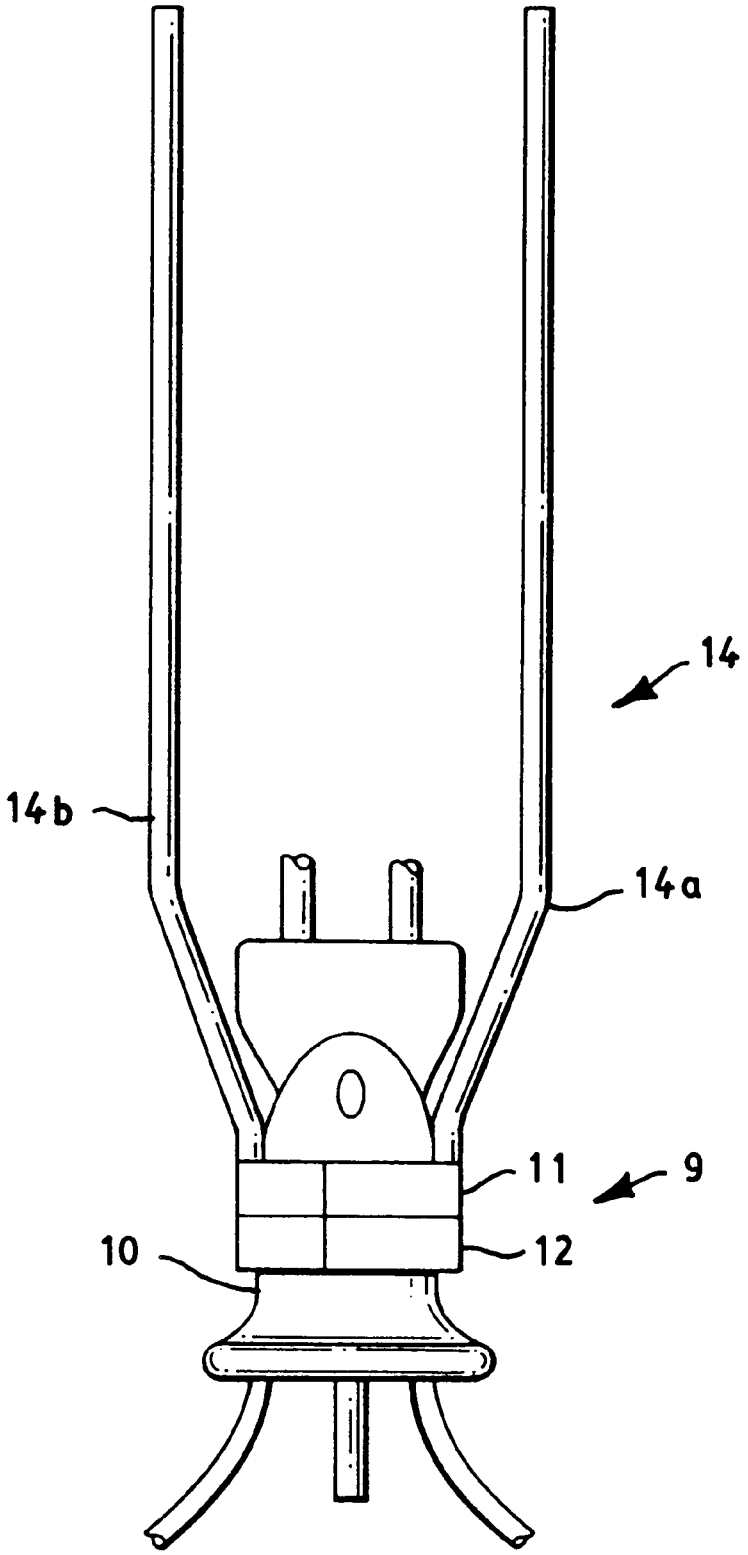
FIG. 3 is an elevation view of the mount assembly of the invention affixed to a glass stem.

Another important consideration in reducing stresses upon the glass stem 10, as well as in the remainder of the assembly, is the positioning of the banding straps as illustrated in FIG. 2. The banding strap 12 is positioned beneath strap 11 in a reverse order; i.e., the closed crimp section 12*a* of strap 12 is aligned with the open crimp section 11*b*. Since, during the crimping operation, the open crimp sections are provided with a sliding fit, tensions and stresses are equalized, resulting in reduced breakage, and greatly strengthening the mount assembly.

The areas 14*c* of the rods 14*a* and 14*b* are received into the mount frame receiving areas 11*c*, 11*d*, 12*c* and 12*d* and are fixed therein, preferably by welding.

In a preferred embodiment of the invention, the banding straps are formed from nickel plated cold rolled steel and the elongated rods are formed from stainless steel wire.

There is thus provided a mount assembly having a banding system that releases excess tension as it is affixed to the glass stem of the lamp. It provides a firm support for the arc tube and greatly reduces breakage during assembly.

While there have been shown and described what are at present considered the preferred embodiments of the invention, it will be apparent to those skilled in the art that various changes and modifications can be made herein without departing from the scope of the invention as defined by the appended claims.

What is claimed is:

1. A mount assembly comprising:

first and second axially aligned annular banding straps, each of said banding straps having a closed crimp section and an open crimp section diametrically opposed to one another, said banding straps being positioned so the closed crimp of said first strap overlies the open crimp of said second strap;

a pair of diametrically opposed mount frame receiving areas, said mount frame receiving areas being positioned substantially equidistantly between said crimp sections;

and a mount frame comprised of two elongated rods, each of said rods having a portion fixed in one of said mount frame receiving areas.

2. The mount assembly of claim 1 wherein said banding straps have an inside circumference and said portions of said elongated rods fixed in said mount frame receiving areas are formed to have a surface conforming to said inside circumference.

3. The mount assembly of claim 2 wherein said elongated rods are welded in said mount frame receiving areas.

4. The mount assembly of claim 3 wherein said banding straps are formed from nickel plated cold rolled steel.

5. The mount assembly of claim 4 wherein said elongated rods are formed from stainless steel wire.

6. The mount assembly of claim 2 wherein said portions of said elongated rods are coined.

* * * * *